US011583470B2

(12) United States Patent
Akers et al.

(10) Patent No.: US 11,583,470 B2
(45) Date of Patent: Feb. 21, 2023

(54) PULMONARY VEST FOR ELECTRO-SONIC STIMULATION TREATMENT

(71) Applicant: Morgan State University, Baltimore, MD (US)

(72) Inventors: Timothy Akers, Baltimore, MD (US); Kofi Nyarko, Essex, MD (US); Gregory Ramsey, Towson, MD (US); Cassandra Dickerson, Landover, MD (US)

(73) Assignee: MORGAN STATE UNIVERSITY, Baltimore, MD (US)

( * ) Notice: Subject to any disclaimer, the term of this patent is extended or adjusted under 35 U.S.C. 154(b) by 63 days.

(21) Appl. No.: 16/712,143

(22) Filed: Dec. 12, 2019

(65) Prior Publication Data

US 2020/0188225 A1 Jun. 18, 2020

Related U.S. Application Data

(60) Provisional application No. 62/778,609, filed on Dec. 12, 2018.

(51) Int. Cl.
*A61H 23/02* (2006.01)

(52) U.S. Cl.
CPC ... *A61H 23/0236* (2013.01); *A61H 2201/165* (2013.01); *A61H 2201/5023* (2013.01); *A61H 2205/081* (2013.01); *A61H 2205/084* (2013.01)

(58) Field of Classification Search
CPC ..... A61H 23/0236; A61H 2201/165
See application file for complete search history.

(56) References Cited

U.S. PATENT DOCUMENTS

| | | | | |
|---|---|---|---|---|
| 5,693,073 | A * | 12/1997 | Glick | A61J 17/101 606/236 |
| 6,193,677 | B1 * | 2/2001 | Cady | A61H 23/0236 601/1 |
| 2009/0005713 | A1 * | 1/2009 | Podrazhansky | A61H 23/0236 601/2 |
| 2014/0005579 | A1 * | 1/2014 | Drlik | A61H 23/0218 601/111 |
| 2014/0190481 | A1 * | 7/2014 | Jam | A61M 16/024 128/203.12 |
| 2015/0141879 | A1 * | 5/2015 | Harper | A61M 21/00 601/46 |
| 2016/0095782 | A1 * | 4/2016 | Shockley, Jr. | A61B 5/055 601/93 |

* cited by examiner

*Primary Examiner* — Margaret M Luarca
*Assistant Examiner* — Cana A Gallegos
(74) *Attorney, Agent, or Firm* — Whiteford, Taylor & Preston, LLP; Peter J. Davis

(57) ABSTRACT

A device and method for loosening mucous secretions from a subjects lungs including a vest-like garment having enclosures thereon, the enclosures containing one or more sonic transducers, the output face of which is arranged to face the subject's body, the sonic transducers configured to repeatedly emit sonic bursts having a duration of about 10 to about 50 milliseconds at one or more frequencies ranging from 100 Hz-400 Hz, at a rate of about one to about four bursts per second.

16 Claims, 4 Drawing Sheets

PULMONARY VEST FOR ELECTRO-SONIC STIMULATION TREATMENT

BACKGROUND OF THE INVENTION

Field of the Invention

The present invention relates to methods and devices for stimulating the mucous membranes of the bronchial tubes to assist with opening the airway passages for less labored breathing, reduced stressful inhalation and exhalation, and greater oxygen intake.

SUMMARY OF THE INVENTION

The present invention is a vest with attached sonic transducers configured to deliver electro-sonic treatment to the upper and lower sections of the wearer's thoracic cavity and subdermal layers of the chest wall and the back-chest cavity. The electro-sonic stimulation treatment will serve as sonic compressions to break-up or release the mucous secretions that are blocking the bronchial tubes. The present invention moves the treatment of respiratory congestion from percussions, compressions, and kinetic disruptions, to electro-sonic stimulation through frequency oscillation.

The present invention is directed to a pulmonary vest that is worn as a regular part of the attire, either directly on the skin or as an outer garment. The pulmonary vest of the invention includes an array of sonic transducers, numbered, sized, and arranged depending on the amount and location(s) of sonic stimulation desired, directed to the affected bronchial cavities. The array transducers will provide an overlapping wave form of the affect areas of the thoracic region.

Each transducer will emit sound at a frequency in the range of about 100 Hz to about 400 Hz. According to a preferred embodiment, each transducer will emit sound at a frequency in the range of about 200 Hz to about 240 Hz. According to some embodiments, each transducer may emit sound at a frequency that is the same or different from the frequency of sound emitted from other transducers. And according to a most preferred embodiment, each transducers will emit sound at a frequency of about 220 Hz. The transducers will be preferably covered by a thin membrane to protect the outer speaker head as it is directed toward the thoracic region of the affected area. During activation of the transducers, they will emit a sonic burst lasting about 10 to 50 milliseconds, repeated at a rate of about one to about 4 bursts per second. The preferred sonic burst is a 30 millisecond burst. This has been shown to affect larger secretions of mucous from the lungs.

The pulmonary vest according to the invention may also have a user interface configured to allow the user to control the frequency modulation within predetermine safety and effectiveness limits based on the distance to be penetrated by the sonic frequency oscillation, depending on body type and/or layers of clothing, thereby eliminating any risk to tissue, organs, or hearing, while still providing effective treatment. Automatic control and safety mechanisms may also be provided, programmed into the sonic oscillators to ensure safety.

According to a preferred embodiment of the invention, the sonic transducers will be secured to the vest with one or more thoracic transducer stabilizers. The thoracic transducer stabilizer will preferably be a transparent pouch or box made of semi-rigid plastic, for example, of the type used for clamshell packaging. The thoracic transducer stabilizers are configured to be attached to the pulmonary vest by stitching, hook and loop (Velcro), or other convenient means.

The pulmonary vest according to the invention will also preferably contain one or more pockets or pouches to hole a rechargeable battery pack to provide for continuous operation, as well as the user control interface.

Figure 1:
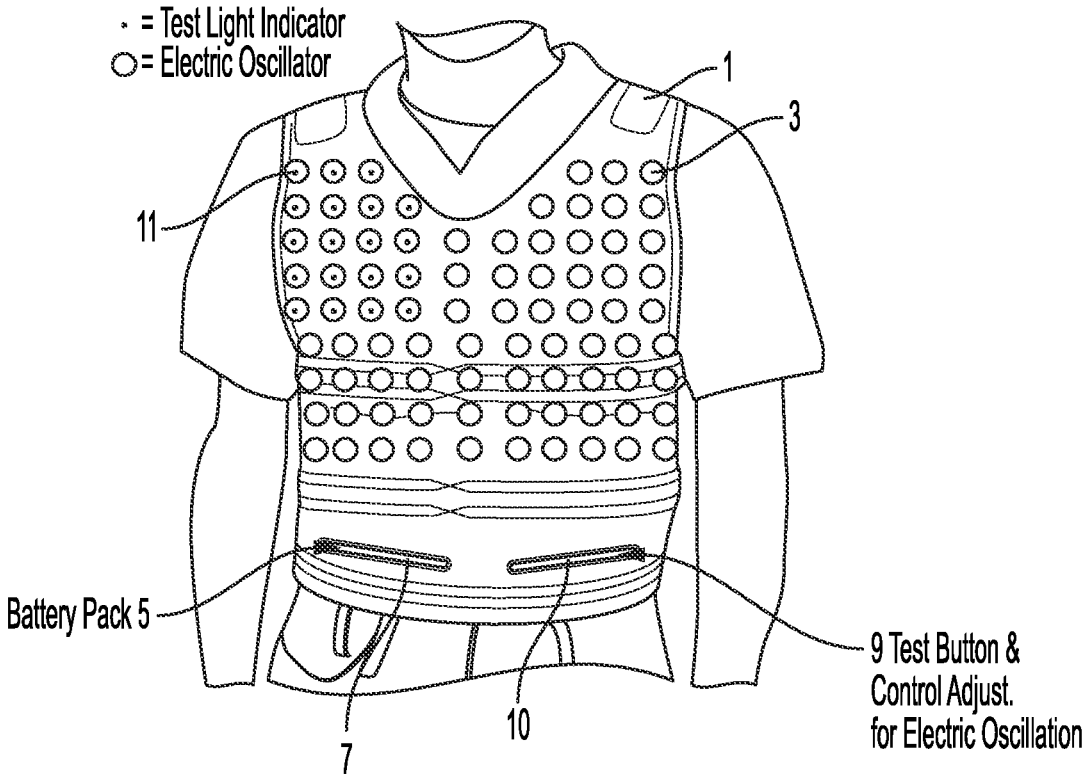
FIG. 1 is an example of a pulmonary vest with sonic transducers according to an embodiment of the invention.

The following reference numerals are used to identify various features of the invention depicted in the figures:

| | |
|---|---|
| 1 | pulmonary vest |
| 3 | sonic oscillator |
| 5 | portable power source |
| 7 | power source pocket |
| 9 | user control interface |
| 10 | pocket |
| 11 | test light indicator |
| 13 | large sonic transducer |
| 15 | thoracic transducer stabilizer |
| 17 | perimeter holes |
| 19 | elongated holes |

DETAILED DESCRIPTION

FIG. 1 shows a pulmonary vest 1 according to a first embodiment of the invention. A plurality of small electric sonic oscillators 3 are affixed to the vest 1 in an array. Each electronic oscillator 3 is powered by a portable power source, such as battery pack 5, resting in a pocket 7 of the vest. In addition, each electronic oscillator 3 is wired to, or in wireless communication with, a user control interface 9 which is configured to turn each electric oscillator on and off, and to control the amount of oscillation delivered by each electric oscillator within a predetermined range. In addition, one or more electric oscillators may include a test light indicator 11 to indicate when the oscillator is operating. The user control interface 9 may be configured to allow the user to control each electric oscillator 3 individually, predetermined groups of oscillators, and/or all electric oscillators at the same time to provide customized stimulation treatment.

Figure 2:
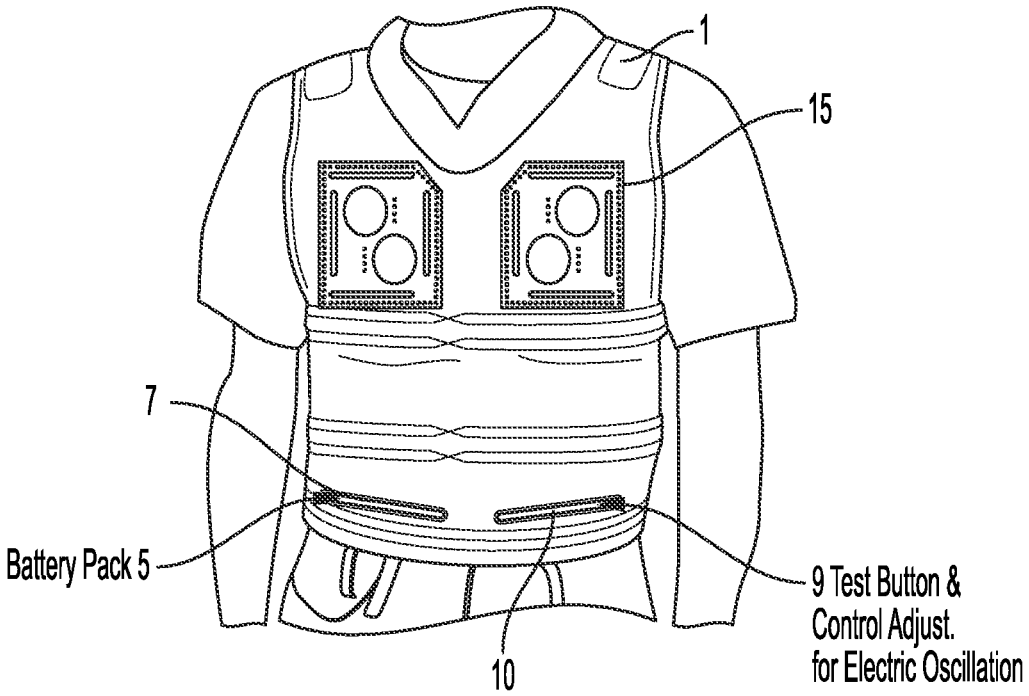
FIG. 2 is an example of a pulmonary vest with sonic transducers according to another embodiment of the invention.
Figure 3:
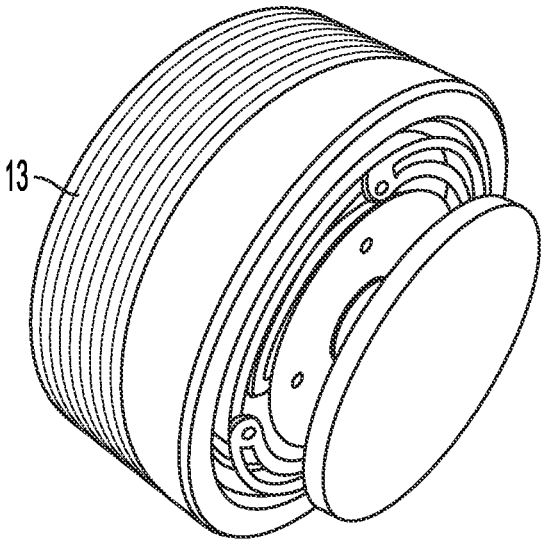
FIG. 3 is an example of a sonic transducer that may be used according to various embodiments of the invention.
Figure 4:
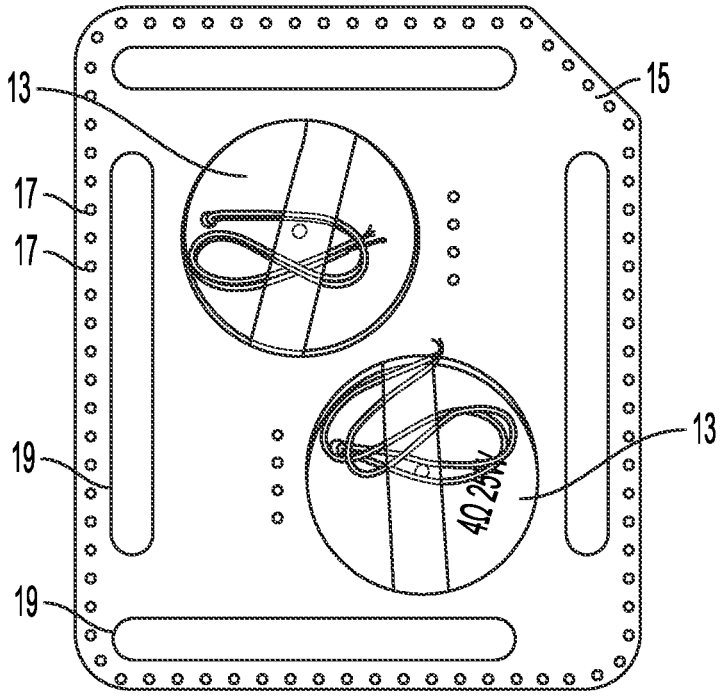
FIG. 4 is an outside facing view of a thoracic transducer stabilizer containing two sonic transducers according to an embodiment of the invention.
Figure 5:
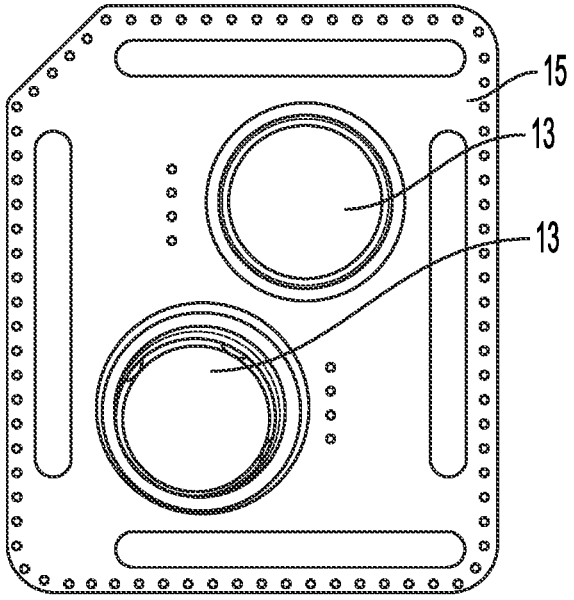
FIG. 5 is a reverse view (body facing view) of the thoracic transducer stabilizer and two sonic transducers shown in FIG. 4.

FIG. 2 shows an alternate embodiment of the pulmonary vest 1 according to the invention in which larger and more powerful sonic transducers 13 are provided (see FIG. 3). These transducers 13 emit a large sonic wave form to impact the mucus membranes, penetrating epidermal layers, in the thoracic region. According to the embodiment shown in FIG. 2, the sonic transducers 13 are situated inside a thoracic transducer stabilizer (TTS) 15. The thoracic transducer stabilizer 15 is preferably a transparent pouch or box made of semi-rigid plastic, for example, of the type used for blister pack or clamshell packaging. See FIGS. 4, 5 and 7. The thoracic transducer stabilizers 15 are configured to be attached and stabilized to the pulmonary vest 1 by stitching, hook and loop (Velcro), or other convenient means. As with the embodiment of FIG. 1, the pulmonary vest of FIG. 2 includes a power source 5 and power source pocket 7, as well as a user-interface/controller 9 and corresponding pocket 10.

Figure 6:
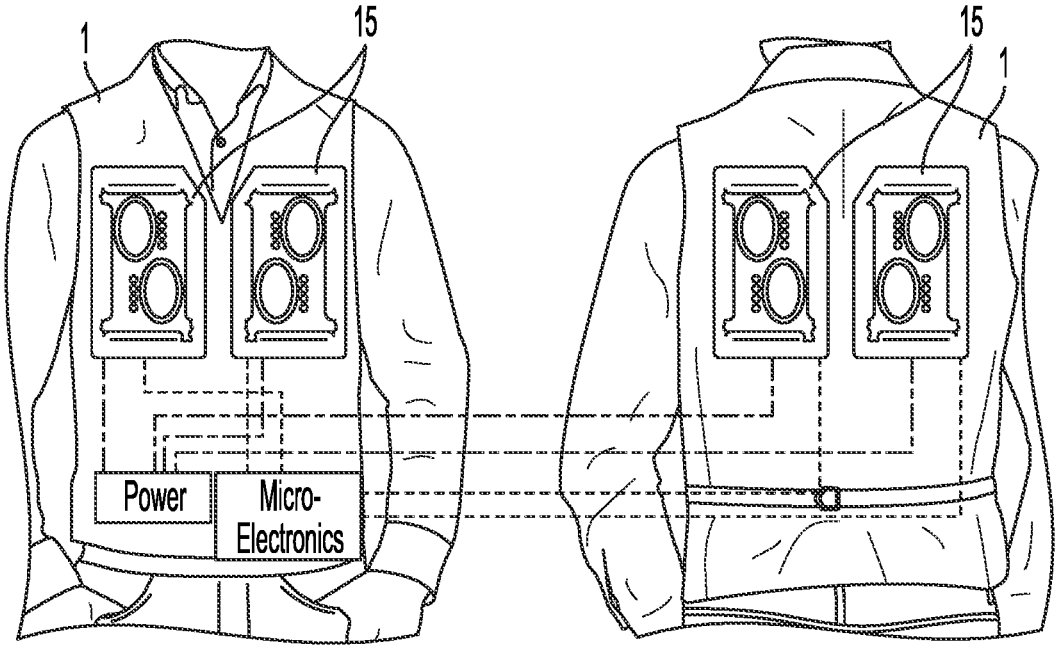
FIG. 6 is a representation of a pulmonary vest with thoracic transducer stabilizers with sonic transducers on front and back surfaces according to another embodiment of the invention, and showing power and micro-electronics connections.

According to a further embodiment of the invention, the sonic transducers 13 may be provided on both chest and back portions of the vest 1, see e.g., FIG. 6. FIG. 6 shows a pulmonary vest 1 according to an embodiment of the invention in which the larger transducers 13 are secured to left and right sides of both the chest and back portions of the vest 1 using the thoracic transducer stabilizers 15. FIG. 6 also illustrates the simplified wiring schematic of the front and back sides of the pulmonary vest 1. Each transducer 13 associated with corresponding thoracic transducer stabilizers 15 may have its own independent power source and microelectronic circuitry control and monitoring.

Each transducer will emit sound at a frequency in the range of about 100 Hz to about 400 Hz. According to a preferred embodiment, each transducer will emit a sonic burst at a frequency in the range of about 200 Hz to about 240 Hz. According to some embodiments, each transducer may emit sound at a frequency that is the same or different from the frequency of sound emitted from other transducers. And according to a most preferred embodiment, each transducers will emit sound at a frequency of about 220 Hz. The duration of each sonic burst may be about 10 milliseconds to about 50 milliseconds, and preferably about 30 milliseconds.

Figure 7:
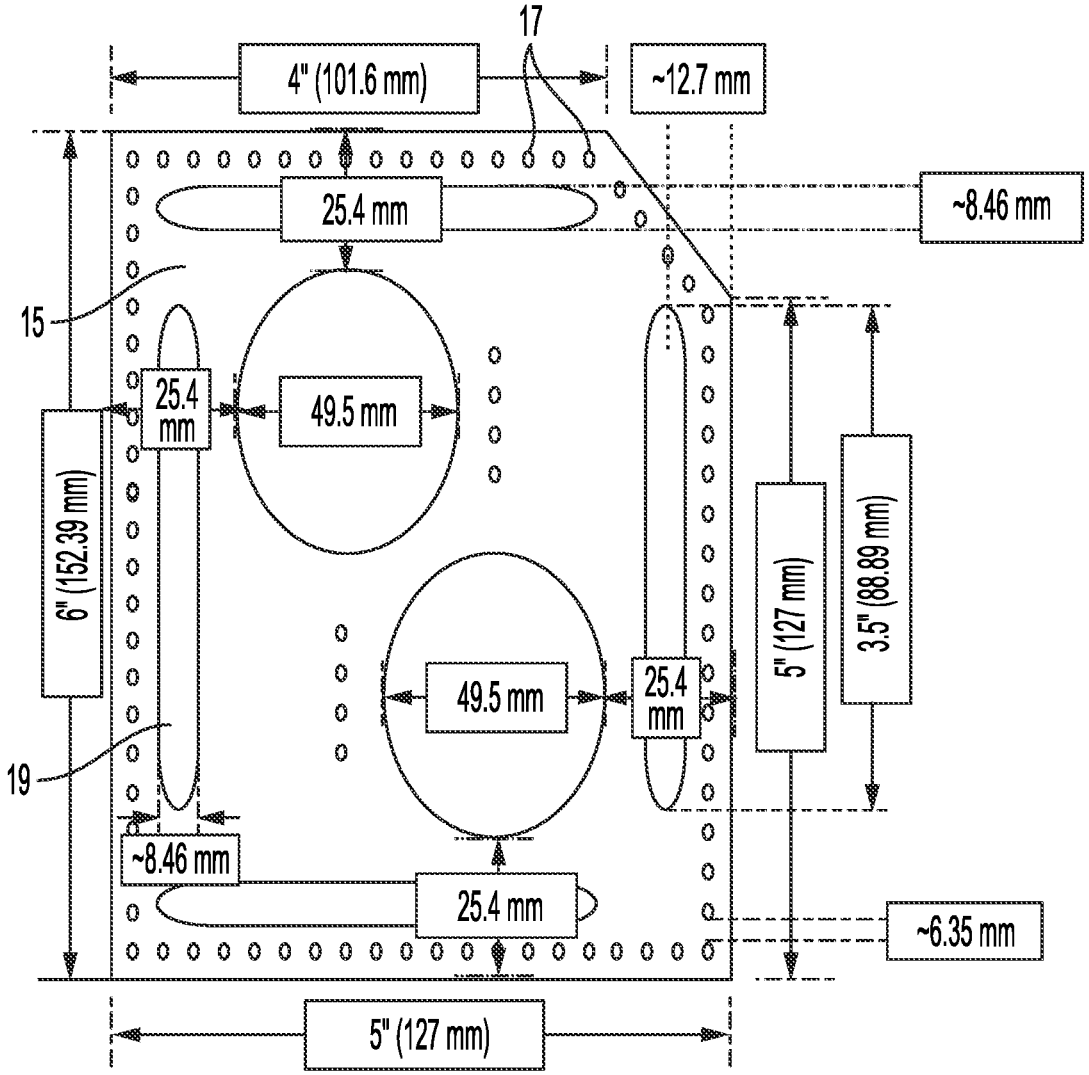
FIG. 7 is a schematic diagram of a thoracic transducer stabilizer according to an embodiment of the invention.

FIG. 7 shows a preferred embodiment of a design for the thoracic transducer stabilizer 15 according to the invention. The thoracic transducer stabilizer design and measurement pattern shown in FIG. 7 is specifically configured to stabilize each of the transducers 13 to the body of the pulmonary vest 1. The thoracic transducer stabilizer 15 has perimeter holes 17 used for threading while the elongated holes 19 may be provided for adjustment and sensor placement.

The invention claimed is:

1. An article of manufacture comprising:

a garment configured to be draped over a wearer's shoulders and including a chest piece and a back piece;

said garment comprising a plurality of semi-rigid plastic clamshell containers attached via hook and loop system to at least one of said chest piece and said back piece;

each of said semi-rigid plastic clamshell containers containing therein at least two sonic transducers arranged so that an output face of each sonic transducer is facing said garment;

each said semi-rigid plastic clamshell container having a first elongated slot along a first edge of said semi-rigid plastic clamshell container and a second elongated slot along a second edge of said semi-rigid plastic clamshell perpendicular to said first elongated slot, said first and second elongated slots located and arranged to permit location adjustment of said at least two sonic transducers within said semi-rigid plastic clamshell containers, a power source supported by said garment and attached to each of said at least one sonic transducer;

a user control interface supported by said garment and attached to each of said at least one sonic transducer;

wherein each of said at least two sonic transducers is configured to emit a sonic burst one to four times per second, each of said sonic bursts emitting sound at a frequency of about 100 Hz to about 400 Hz, and wherein a speaker head of each sonic transducer is covered by a protective membrane.

2. An article according to claim 1, comprising two said sonic transducer-containing semi-rigid plastic clamshell containers attached to a chest piece of said garment.

3. An article according to claim 1, comprising two said sonic transducer-containing semi-rigid plastic clamshell containers attached to a back piece of said garment.

4. An article according to claim 1, wherein said user control interface is configured to provide independent power, frequency and amplitude control to each of said at least two sonic transducers.

5. An article according to claim 1, wherein said user control interface is configured to provide power, frequency and amplitude control to groups of said at least two sonic transducers.

6. An article according to claim 1, wherein each of said at least two sonic transducers is configured to repeatedly emit a sonic burst at a frequency of about 200 Hz to about 240 Hz at a rate of about one to about four bursts per second.

7. An article according to claim 6, wherein each said at least two sonic transducers is configured to repeatedly emit a sonic burst at a frequency of about 220 Hz at a rate of about one to about four bursts per second.

8. An article according to claim 1, wherein each said sonic burst occurs for a period of from about 10 to about 50 milliseconds.

9. An article according to claim 1, wherein each said sonic burst occurs for a period of about 30 milliseconds.

10. A method for loosening mucous secretions from a subject's lungs, comprising applying pulsed audio signals to the subject's chest cavity using at least two sonic transducers, said at least two sonic transducers contained in a semi-rigid plastic clamshell container attached via hook and loop system to a garment configured to be draped over the subject's shoulders and including a chest piece and a back piece;

each said semi-rigid plastic clamshell container having a first elongated slot along a first edge of said semi-rigid plastic clamshell container and a second elongated slot along a second edge of said semi-rigid plastic clamshell perpendicular to said first elongated slot, said first and second elongated slots located and arranged to permit location adjustment of said at least two sonic transducers within said semi-rigid plastic clamshell containers, said at least two sonic transducers each arranged so that an output face thereof is facing said subject; said garment supporting a power source for said at least two sonic transducers and a user control interface;

wherein each said at least two sonic transducers are configured to emit a sonic burst one to four times per second, each of said sonic bursts emitting sound at a frequency of about 100 Hz to about 400 Hz, and wherein a speaker head of each sonic transducer is covered by a protective membrane.

11. A method according to claim 10, wherein said garment, comprises two said sonic transducer-containing semi-rigid plastic clamshell containers attached to said chest piece of said garment.

12. A method according to claim 10, comprising two said sonic transducer-containing semi-rigid plastic clamshell containers attached to said back piece of said garment.

13. A method according to claim 10, wherein said user control interface is configured to provide independent power, frequency and amplitude control to each of said at least two sonic transducers.

14. A method according to claim 10, wherein said user control interface is configured to provide power, frequency and amplitude control to groups of said at least two sonic transducers.

15. A method according to claim 10, comprising repeatedly emitting a sonic burst from said at least two sonic transducers at a frequency of about 200 Hz to about 240 Hz at a rate of about one to about four bursts per second.

16. A method according to claim 10, wherein each said sonic burst occurs for a period of from about 10 to about 50 milliseconds.

* * * * *